United States Patent [19]

DiPietro

[11] Patent Number: 4,673,369

[45] Date of Patent: Jun. 16, 1987

[54] MAGNETIC ALIGNMENT TOY

[76] Inventor: Vincent DiPietro, c/o Enzo Transmission, 250 Centre St., Quincy, Mass. 02169

[21] Appl. No.: 791,133

[22] Filed: Oct. 24, 1985

[51] Int. Cl.[4] ..... A63H 33/26

[52] U.S. Cl. ..... 446/133; 40/427; 335/306

[58] Field of Search ..... 446/129, 133, 134, 132, 446/131, 135, 136; 273/1 GD, 1 M, 239; 335/306, 288; 434/301; 40/474, 427

[56] References Cited

U.S. PATENT DOCUMENTS 3,817,518 6/1974 Routson ..... 273/1 GD 4,404,766 9/1983 Toth ..... 446/129

*Primary Examiner*—Mickey Yu

*Attorney, Agent, or Firm*—M. Lawrence Oliverio

[57] ABSTRACT

A magnetic alignment toy comprising a central rotatable wheel having at least two pair of magnets disposed on its circumference, as many peripheral rotatable wheels as there are magnets on the central wheel evenly spaced around the central wheel, each of the peripheral wheels having as many magnets disposed around their circumference as the central wheel has, and a strong master magnet movable around the outside periphery of the peripheral wheels along a path bringing the master magnet into periodic magnetic interactive adjacency to the outermost magnet disposed on each peripheral wheel.

7 Claims, 7 Drawing Figures

MAGNETIC ALIGNMENT TOY

BACKGROUND OF THE INVENTION

The present invention relates to color scheme arrangement or placement toys and specifically to toys whose object is to arrange various elements according to a specific color scheme or other pattern arrangement via the manipulation and alignment of magnetic elements.

Various toys exist whose object is to physically manipulate the toy to achieve a visually recognizable pattern of colors. Such toys typically work to arrange such patterns solely by movement of mechanically connected parts.

SUMMARY OF THE INVENTION

In accordance with the invention there is provided a magnetic alignment toy comprising: a central rotatable wheel having at least two pair of magnets disposed on the circumference of the central wheel, each of the magnets of each pair being disposed in 180 degree relationship to each other; as many peripheral rotatable wheels as there are magnets on the central wheel, the peripheral wheels being evenly spaced around the central wheel and having as many pair of magnets disposed around their circumference in 180 degree relationship to each other as the central wheel has; a strong master magnet movable around the outside periphery of the peripheral wheels along a path bringing the master magnet into periodic magnetic interactive adjacency to the outermost magnet disposed on each peripheral wheel; wherein the magnets disposed on all of the central and peripheral wheels alternate in polarity around the circumference of the wheels; and, wherein the peripheral wheels are disposed around the central wheel so as to allow periodic magnetic interactive adjacency of the magnets on the peripheral wheels with the magnets on the central wheel when any of the wheels are rotated.

The central wheel preferably includes a mechanism for manually rotating the central wheel. The master magnet is typically disposed on a manually rotatable ring surrounding the outside periphery of the peripheral wheels. Most preferably, the peripheral wheels are serially mounted adjacent to each other around the central wheel so as to allow magnetic interaction between one or more magnets which are disposed on the circumference of adjacent peripheral wheels.

The wheels and the ring are mounted between a pair of substantially parallel transparent plates, the plates being attached by links extending between the plates and spaced around the outside periphery of the peripheral wheels, wherein the ring is disposed inside the links for slidably rotatable movement of the ring between the plates and around the periphery of the peripheral wheels.

The wheels may include pins and the plates may include mechanisms for receiving the pins for rotatable mounting of the wheels between the plates. Alternatively, the plates may include pins and the wheels may include the mechanisms for receiving the pins for such rotatable mounting.

BRIEF DESCRIPTION OF THE DRAWINGS

Other objects, features and advantages will be apparent from the following detailed description of preferred embodiments taken in conjunction with the accompanying drawings in which.

DETAILED DESCRIPTION OF PREFERRED EMBODIMENTS

Figure 1:
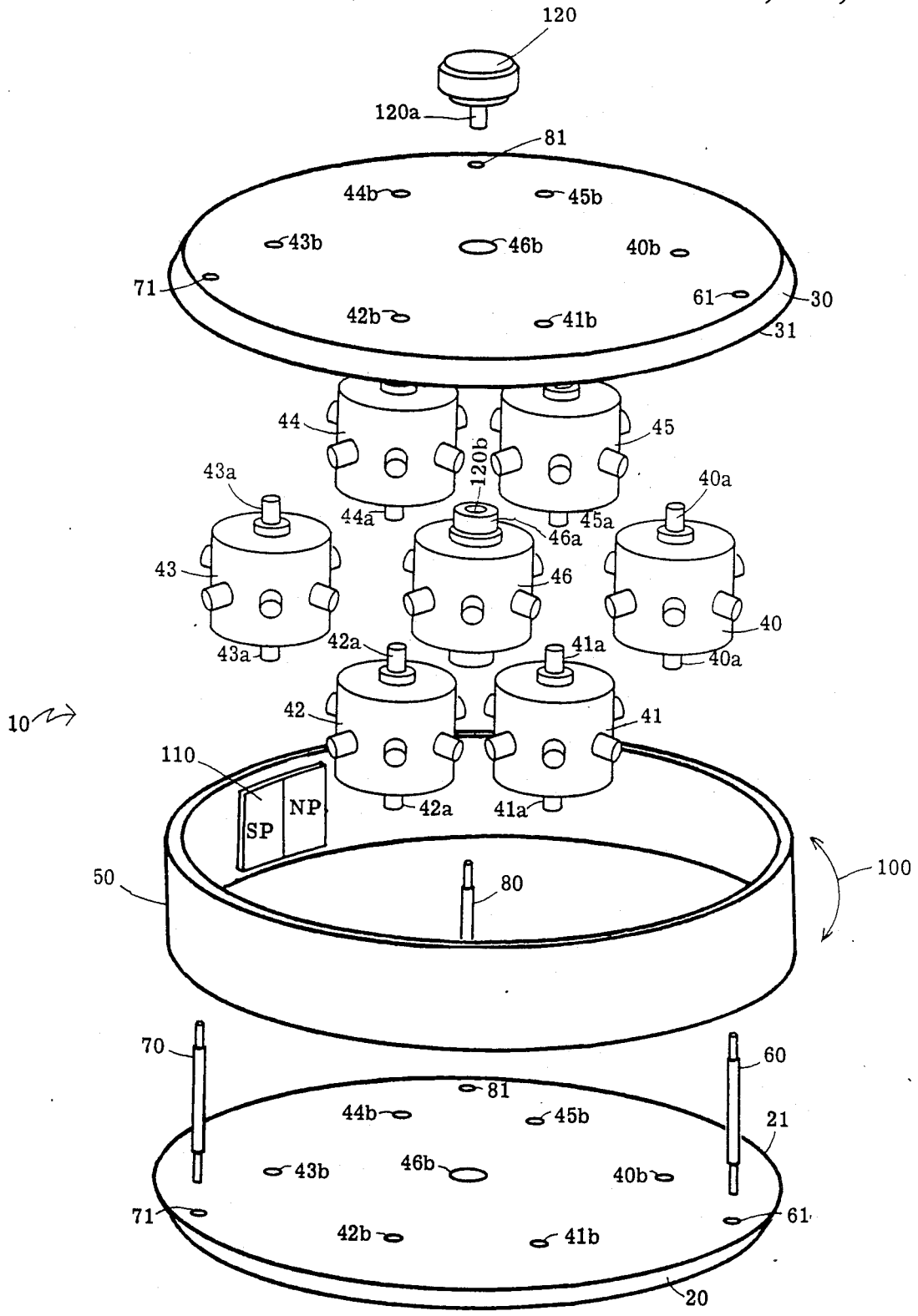
FIG. 1 is an exploded isometric view of a magnetic alignment toy according to the invention.

With reference to FIG. 1 there is shown a magnetic alignment toy 10 in exploded view. The toy 10 includes a pair of outside alignment plates 20, 30 between are sandwiched six peripheral wheels 40, 41, 42, 43, 44, 45 and a central wheel 46, all of which are generally cylindrical in shape and whose central axes are aligned parallel to each other when mounted between plates 20, 30. Also disposed between plates 20, 30 is a circular wheel 50 which surrounds all of wheels 40–46. Plates 20, 30 typically comprise a transparent material preferably plastic, in order that the user may view the wheels sandwiched therebetween. Wheels 40–46 are typically cylindrical in shape, but may have other geometrical shapes such as square, hexagonal, octagonal and the like.

Plates 20, 30 are attached in generally parallel relationship to each other via pins 60, 70, 80 which fit snugly into complementary sets of apertures 61, 71, 81 which are disposed adjacent the outside circumferential edges 21, 31 of plates 20, 30, FIG. 1. Circular wheel 50 is selected to have a diameter just slightly smaller than the circle on whose circumference pins 60, 70, 80 would lie such that circular wheel 50 is held in place between pins 60, 70, 80 and thereby prevented from any substantial lateral movement between plates 20, 30. Wheel 50 typically comprises a transparent material, preferably plastic. Such mounting of circular wheel 50 between pins 60, 70, 80 and plates 20, 30 allows wheel 50 to be rotated circularly 360 degrees around the axis of the wheel 50 when engaged by hand, FIG. 1. Each of the cylindrical wheels 40–46 are mounted between plates 20, 30 via a pair of pins **40*a*, 41*a*, 42*a*, 43*a*, 44*a*, 45*a*, 46*a* which are received by a pair of complementary apertures 40*b*, 41*b*, 42*b*, 43*b*, 44*b*, 45*b*, 46*b* respectively. Apertures 40*b*–46*b* have a larger diameter than the diameter of pins 41*a*–46*a* such that the pins are readily rotatable within the apertures and, a fortiori, wheels 40–46 are freely rotatable between plates 20, 30**.

Figure 3:
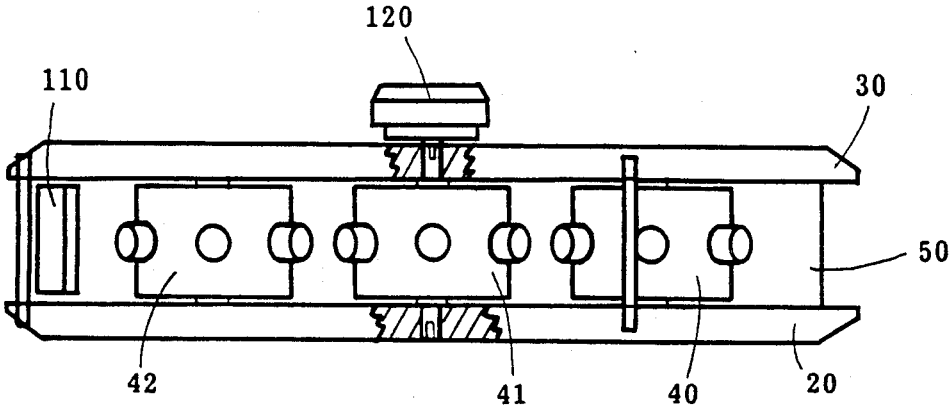
FIG. 3 is a side view of the toy of FIG. 1.

A spinning handle 120 is provided, FIG. 1. The handle 120 includes a pin **120*a* which fits snugly into a complementary aperture 120*b* provided in pin 46*a* on central wheel 46. Such snug fitting allows the user of toy 10 to turn or rotate wheel 46 from the top surface of plate 30. As shown in FIG. 3, handle 120 is attached to wheel 46 by snug fitting engagement of pin 120*a* into aperture 120*b*, FIG. 4**.

Figure 4:
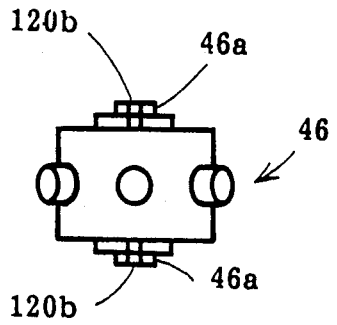
FIG. 4 is a side view of a central rotatable wheel for manual turning and use in the toy of FIG. 1.
Figure 5:
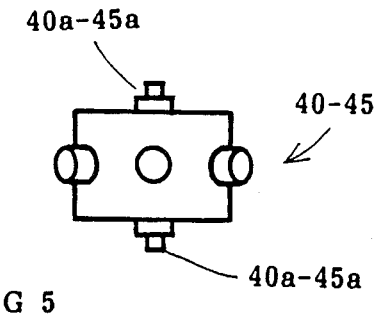
FIG. 5 is a side view of a peripheral freely rotatable wheel for use in the device of FIG. 1.

FIG. 4 shows central wheel 46 in side view and demonstrates in greater detail a preferred stepped configuration for pin **46*a* and the central aperture 120*b* into which pins 120***a* snugly fit, FIG. 1. FIG. 5 shows one of any of peripheral wheels 40–45 in side view and demonstrates a preferred stepped configuration for a pin 40*a*–45*a*.

As shown in FIGS. 4, 5 the stepped configuration of pins 40*a*–46*a* allows the top portion of the pins 40*a*–46*a* to be insertable within the complementary apertures 40*b*–46*b*, FIG. 1, and allows the wider diameter lower portion of pins 40*a*–46*a* to act as a buffer between the main cylindrical body of a wheel 40–46 and the plates 20, 30 thereby eliminating friction during rotation between the top or bottom surfaces of wheels 40–46 and the bottom surfaces of plates 20, 30.

Figure 2:
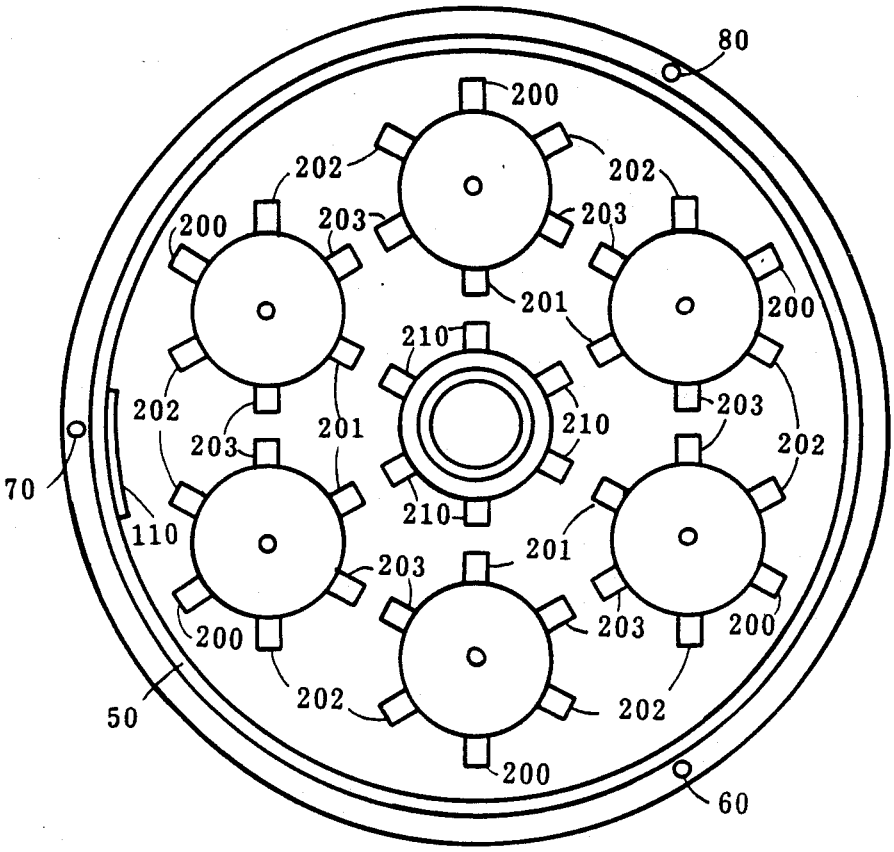
FIG. 2 is a top view of the toy shown in FIG. 1.
Figure 6:
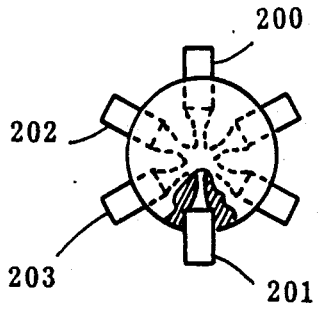
FIG. 6 is a cross sectional view of a central and-or peripheral wheel for use in the device of FIG. 1.
Figure 7:
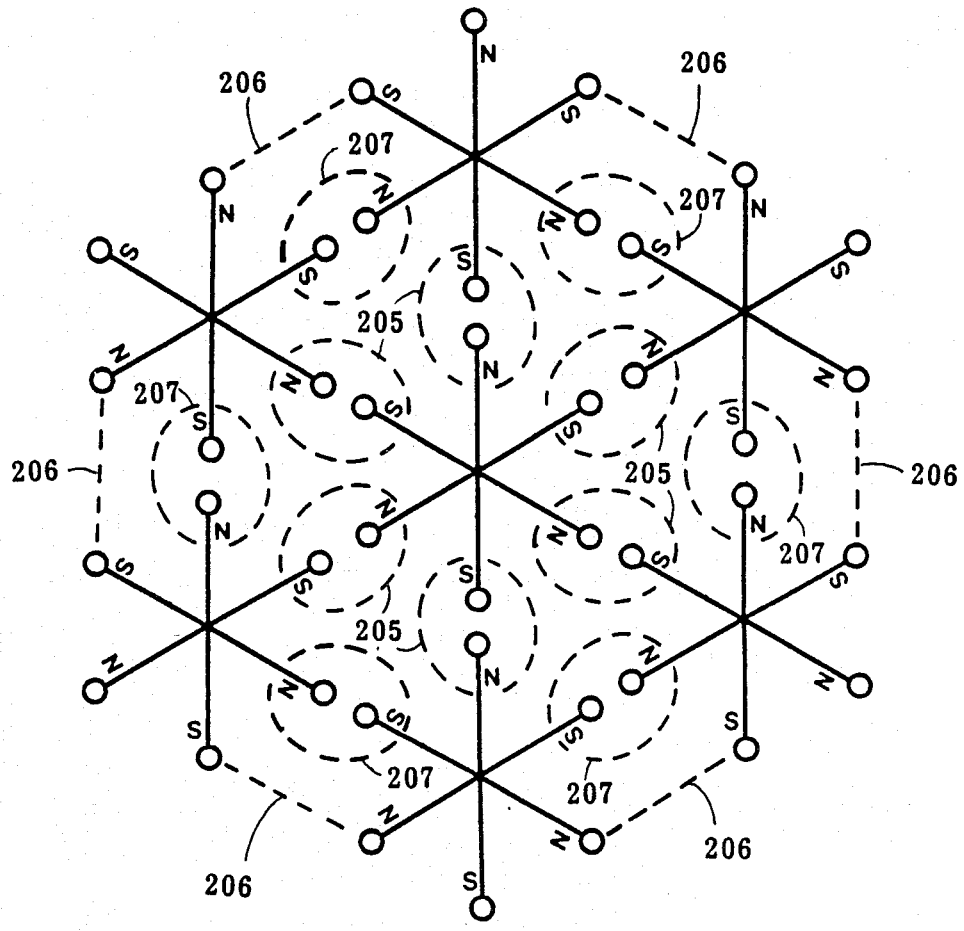
FIG. 7 is a geometrical schematic layout of the arrangement of the wheels and the alignment of the magnets of the toy of FIG. 1 at their lowest energy or normal state.

With reference to FIGS. 2, 6, 7 each of wheels 40–45 include six magnets, an outside magnet 200, inside magnet 201, and four side magnets 202, 203. All of magnets 200–203 are positioned equidistant from each other around the circumference of each wheel 40–45. As shown in FIGS. 2, 7, the magnets as represented schematically by circles in FIG. 7 alternate in north, south (N, S. FIG. 7) polarity around each of wheels 40–45, FIG. 2. Central wheel 46 also includes as many evenly spaced medium-strength magnets 210 as each of wheels 40–45 has.

As best shown in FIG. 7 the result of the alternating polarity arrangement of the evenly spaced magnets 200, 201, 202, 203 and 210 around wheels 40–46, FIG. 2, is a magnetic interaction between each of magnets 210 and inside magnets 201 as shown by phantom line 205. Such alternating polarity arrangement also results in magnetic interaction of each of side magnets 203 as shown by phantom lines 207 and magnetic interaction of each of side magnets 202 as shown by phantom lines 206, FIG. 7.

The magnetic interactions 205, 206, 207, FIG. 7, serve to hold all of wheels 40–45 in the position shown in FIGS. 2, 7 whereby the wheels 40–46 will not freely rotate unless one of the wheels 40–46 is forcibly turned by an outside force. Typically wheel 46 is the only wheel which is rendered accessible via handle 120 for manual turning against the holding magnetic forces 205, 206, 207.

As best shown in FIGS. 2, 3 relatively strong magnet 110 may be periodically brought into close magnetic interactive adjacency to outside magnets 200 upon rotation of wheel 50. As wheel 50 is turned in either direction 100, FIG. 1, magnet 110 will interact with an outside magnet 200 and the interaction, either repellant or attractive depending upon the selected polarity of magnet 110 and the polarity of an outside magnet 200, is sufficient to overcome the attractive magnetic interactive forces 205, 206, 207 which are preventing rotation of whichever of wheels 40–45 is interacting with magnet 110 at a given point in the rotation 100, FIG. 1, of magnet 110 around the periphery of wheels 40–45.

As magnet 110 is rotated, FIGS. 2, 3, on wheel 50 past the outside periphery of wheels 40–45, the interaction of an outside magnet 200 with magnet 110 will cause whichever of wheels 40–45 is interacting with magnet 110 (at a particular moment in the rotation of wheel 50) to rotate.

Wheel 50, movable by hand, may be rotated within pins 60, 70, 80, FIG. 1, at any desired speed, and depending upon the speed at which wheel 50 is rotated, one or more of outside peripheral wheels 40–45 may or may not rotate. If wheel 50 is rotated at a relatively high speed such that magnet 110 is capable of interacting with an outside magnet 200 and/or a magnet 202 FIG. 2, for only a very short period of time, then the particular wheel 40–45 past which magnet 110 is rotated will typically not rotate. If, however, wheel 50 is rotated at a relatively slow rate such that magnet 50 may effectively interact with one or more of magnets 200 or 202, then the particular wheel 40–45 will typically rotate. Again depending upon the speed of rotation of magnet 110, and a fortiori, the amount of time magnet 110 is allowed to interact the wheel 40–45 with which magnet 110 is interacting may be rotated either 60 degrees or more typically 120 degree.

As shown in FIG. 2, magnet 110 is positioned essentially directly between two outside peripheral wheels. If magnet 110 is maintained in the position shown in FIG. 2 and central wheel 46, FIG. 1, is rotated, typically none of the wheels 40–45 will be caused to rotate. If, however, magnet 110 is moved slightly to the left or right of the position shown in FIG. 2 and wheel 46 is then rotated, one or more of wheels 40–45 may be caused to move depending upon the degree of off-center position of magnet 110.

As in the case described above concerning the speed of rotation of magnet 110, if central wheel 46, FIG. 1, is spun around very quickly such that magnets 210, FIG. 2, are not allowed sufficient time to interact with one or more of magnets 201 (and/or 203), none of the wheels 40–45 will typically be caused to rotate.

With reference to FIG. 2, if magnet 110 is rotated into a position such that the center of magnet 110 is essentially directly adjacent an outside magnet 200, and magnet 110 is maintained in such a position, then all of wheels 40–45, FIG. 1, will not be rotated 120 degrees simultaneously by rotating wheel 46. Of course when such a rotation is carried out, the particular outside wheel 40–45 whose outermost magnet 200 is directly adjacent magnet 110 will not be rotated along with the other wheels because such particular wheel is held in position by the stronger magnetic interaction between magnet 110 and the outermost magnet 200.

The various rotation routines described hereinabove are exemplary only however, and other various rotation routines may be predetermined by varying the strengths of one or more of magnets 110, 202, 203, 201 and/or 210, or by varying the distances into which the various magnets 110, 202, 203, 201, 210 are allowed to come into magnetic interactive adjacency with each other at any given position of rotation of a wheel 40–46, 50, FIGS. 1, 2. For example, the distances between magnet 110 and one or more of magnets 200, 202, 203; or the distances between magnets 210 and magnets 201; or the distances between magnets 202; or the distances between magnets 201; etc. may be varied and will, in combination with the relative strengths of the various magnets, allow the various wheels 41–45 to be rotated according to a variety of predetermined magnet 110 and wheel 46 placements and rotations.

In this regard, it is noted that rotation and/or movement of the various wheels 40–45, FIGS. 1, 2, may only be accomplished through rotation and/or movement of either or both of magnets 110 and wheel 46.

Magnet 110 is typically a bipolar magnet itself having a north pole NP and south pole SP, FIG. 1, along its horizontal length. Magnet 110 may be rendered rotatable on wheel 50 itself, such that the north, NP, and south, SP, FIG. 1, poles of magnet 110 may be interchanged from left right to right/left by the user during use. A conventional pin and/or rod means (not shown) may be included to allow rotation of magnet 110; e.g. a pin or rod may be attached to the center of magnet 110, the pin or rod protruding through an aperture in wheel 50 through to the outside surface of wheel 50 whereby the user may rotate the magnet 110. Other conventional means well known in the art may be provided to allow for rotation of magnet 110 on wheel 50.

Most preferably each of the individual magnets 200, 201, 202, 203 are painted or bear separate colors, e.g. magnets 200 are blue, magnets 201 are red, one set of magnets 202 are green and the other yellow, one set of magnets 203 are orange and the other brown. The object of the toy 10 is to achieve an alignment situation as depicted in FIGS. 2, 7 whereby all of the outside magnets 200 are one color, all of the inside magnets 201 are one color, all of the left side magnets 202 are one color, all of the right side magnets 202 are one color, all of the left side magnets 203 are one color and all of the right side magnets 203 are one color. Such color alignment is to be achieved by rotating wheels 40–45 only in the manner described above, i.e. via rotation of wheel 50 and/or rotation of wheel 46.

The toy 10, of FIG. 1, of the invention may alternatively include fewer or more than six peripheral wheels; four or eight are preferred. The number of alternating polarity magnets on each wheel is equal to the number of peripheral wheels and the magnets are evenly spaced around each wheel. However many peripheral wheels are selected for use in the invention, the wheels are evenly spaced around a central wheel having as many magnets on its circumference arranged in evenly spaced alternating polarity relationship as there are peripheral wheels.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. A magnetic alignment toy comprising:

a central rotatable wheel having at least two pairs of magnets disposed on the circumference of the central wheel, each of the magnets of each pair being disposed in 180 degree relationship to each other;

as many peripheral rotatable wheels as there are magnets on the central wheel, said peripheral wheels being evenly spaced around the central wheel and each having as many pairs of magnets disposed around its circumference as the central wheel has, and each magnet of each pair being in 180 degree relationship to each other;

a strong master magnet movable around the outside periphery of the peripheral wheels along a path bringing the master magnet into periodic magnetic interactive adjacency to the outermost magnet disposed on each peripheral wheel;

wherein the magnets disposed on all of the central and peripheral wheels alternate in polarity around each circumference of the wheels; and, wherein the peripheral wheels are disposed around the central wheel so as to allow periodic magnetic interactive adjacency of the magnets on the peripheral wheels with the magnets on the central wheel when any of the wheels are rotated.

2. The toy of claim 1 wherein the central wheel includes means for manually rotating the central wheel.

3. The toy of claim 2 wherein the master magnet is disposed on a manually rotatable ring surrounding the outside periphery of the peripheral wheels.

4. The toy of claim 3 wherein the peripheral wheels are serially mounted adjacent to each other around the central wheel so as to allow magnetic interaction between one or more magnets which are disposed on each circumference of adjacent peripheral wheels.

5. The toy of claim 4 wherein the wheels and the ring are mounted between a pair of substantially parallel transparent plates, the plates being attached by links extending between the plates and spaced around the outside periphery of the peripheral wheels, wherein the ring is disposed inside the links for slidably rotatable movement of the ring between the plates.

6. The toy of claim 5 wherein the wheels include pin means and the plates include means for rotatably receiving the pin means for rotatably mounting the wheels between the plates.

7. The toy of claim 5 wherein the plates include pin means and the wheels include means for rotatably receiving the pin means for rotatably mounting the wheels between the plates.

* * * * *